US010924842B2

(12) United States Patent
Graff et al.

(10) Patent No.: US 10,924,842 B2
(45) Date of Patent: Feb. 16, 2021

(54) AUDIO DEVICE

(71) Applicant: Bose Corporation, Framingham, MA (US)

(72) Inventors: Allen Graff, Sutton, MA (US); David Fustino, Worcester, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/275,604

(22) Filed: Feb. 14, 2019

(65) Prior Publication Data

US 2020/0267464 A1 Aug. 20, 2020

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01); *H04R 2460/17* (2013.01)

(58) Field of Classification Search
CPC ... H04R 1/105; H04R 1/1008; H04R 2460/17
USPC ..... 381/150
See application file for complete search history.

(56) References Cited

U.S. PATENT DOCUMENTS 4,273,969 A * 6/1981 Foley ..... H04M 1/05 174/86
8,345,912 B2 * 1/2013 Akihiko ..... H04R 1/105 379/430
2005/0025329 A1 * 2/2005 Lee ..... H04R 1/105 381/370
2019/0261077 A1 8/2019 Dominijanni et al.

OTHER PUBLICATIONS

Unpublished PCT Application No. PCT/US2018/051450 filed Sep. 18, 2018; Applicant: Bose Corporation.
Unpublished Design U.S. Appl. No. 29/668,233, for Headset; filed Oct. 29, 2018; Applicant: Bose Corporation.

* cited by examiner

*Primary Examiner* — Phylesha Dabney
(74) *Attorney, Agent, or Firm* — Brian M. Dingman; Dingman IP Law, PC

(57) ABSTRACT

An audio device with a body having a length and configured to be worn on or abutting an outer ear of a user, an arm coupled to the body and defining a distal end that is configured to contact an ear root dimple of the user, wherein the arm is configured to be moved relative to the body, and an acoustic module carried by the body and configured to locate a sound-emitting opening anteriorly of and proximate to the user's ear canal opening when the body is worn on or abutting the ear of the user.

20 Claims, 3 Drawing Sheets

AUDIO DEVICE

BACKGROUND

This disclosure relates to an audio device that is worn on the ear.

Wireless headsets deliver sound to the ear. Most wireless headsets include an earbud that is placed into the ear canal opening. Earbuds can inhibit or prevent the user from hearing speech and ambient sounds. Also, earbuds send a social cue that the user is unavailable for interactions with others.

SUMMARY

All examples and features mentioned below can be combined in any technically possible way.

In one aspect, an audio device includes a body having a length and configured to be worn on or abutting an outer ear of a user, an arm coupled to the body and defining a distal end that is configured to contact an ear root dimple of the user, wherein the arm is configured to be moved relative to the body, and an acoustic module carried by the body and configured to locate a sound-emitting opening anteriorly of and proximate to the user's ear canal opening when the body is worn on or abutting the ear of the user.

Examples may include one of the above or below features, or any combination thereof. The body may be configured to contact at least one of the outer ear and the portion of the head that abuts the outer ear proximate the upper portion of the outer ear helix. The body may extend generally along an arc where it is configured to contact at least one of the outer ear and the portion of the head that abuts the outer ear proximate the upper portion of the outer ear helix. The distal end of the arm may comprise an at least partially rounded member that is configured to sit in the ear root dimple. The arm may be flexible. The arm can be made from an elastomer. The arm may be configured to bend along first and second orthogonal bend axes. The arm may lie along an arm longitudinal axis. The first bend axis may be the arm longitudinal axis and the second bend axis may be a vertical axis.

Examples may include one of the above or below features, or any combination thereof. The body may in part lie along a body axis. The arm may be configured to be rotated about the body axis. The arm may be configured to be moved in two directions along the body axis. The arm may be coupled to the body by a sleeve that at least partially surrounds the arm. The sleeve may be configured to have an interference fit with the body to create friction that helps hold the sleeve in place on the body. The sleeve may be configured to be moved in two directions along the body axis and rotate about the body axis. The arm may comprise features that mate with features on the body.

In another aspect, an audio device includes a body having a length and configured to be worn on or abutting an outer ear of a user, wherein the body in part lies along a body axis, a flexible arm coupled to the body and defining a distal end that is configured to contact an ear root dimple of the user, wherein the arm is configured to be moved along the length of the body, to be rotated about the body axis, and to bend along first and second orthogonal bend axes, and an acoustic module carried by the body and configured to locate a sound-emitting opening anteriorly of and proximate to the user's ear canal opening when the body is worn on or abutting the ear of the user.

Examples may include one of the above or below features, or any combination thereof. The distal end of the arm may comprise an at least partially rounded member that is configured to sit in the ear root dimple. The arm may be coupled to the body by a sleeve that at least partially surrounds the arm. The sleeve may be configured to have an interference fit with the body to create friction that helps hold the sleeve in place on the body. The sleeve may be configured to be moved in two directions along the body axis and rotate about the body axis.

DETAILED DESCRIPTION

An audio device, such as a wireless headset, that delivers sound close to an ear canal opening but does not block or obstruct the ear canal is described. The audio device is carried by the ear using a structure that has a partially compliant arm that is configured to be positioned such that the device lightly clamps on the ear with an acoustic module positioned just anteriorly of the ear. The position of the arm and the arm distal end can be adjusted to accommodate different size heads and ears, and different head and ear anatomies, as well as to allow the user to adjust the clamping force on the ear. The audio device is able to be positioned such that it remains in place even as the user moves his or her head. The audio device contemplated herein may include a variety of devices that include an over-the-ear hook, such as a wireless headset, hearing aid, eyeglasses, a protective hard hat, and other open ear audio devices.

Figure 1:
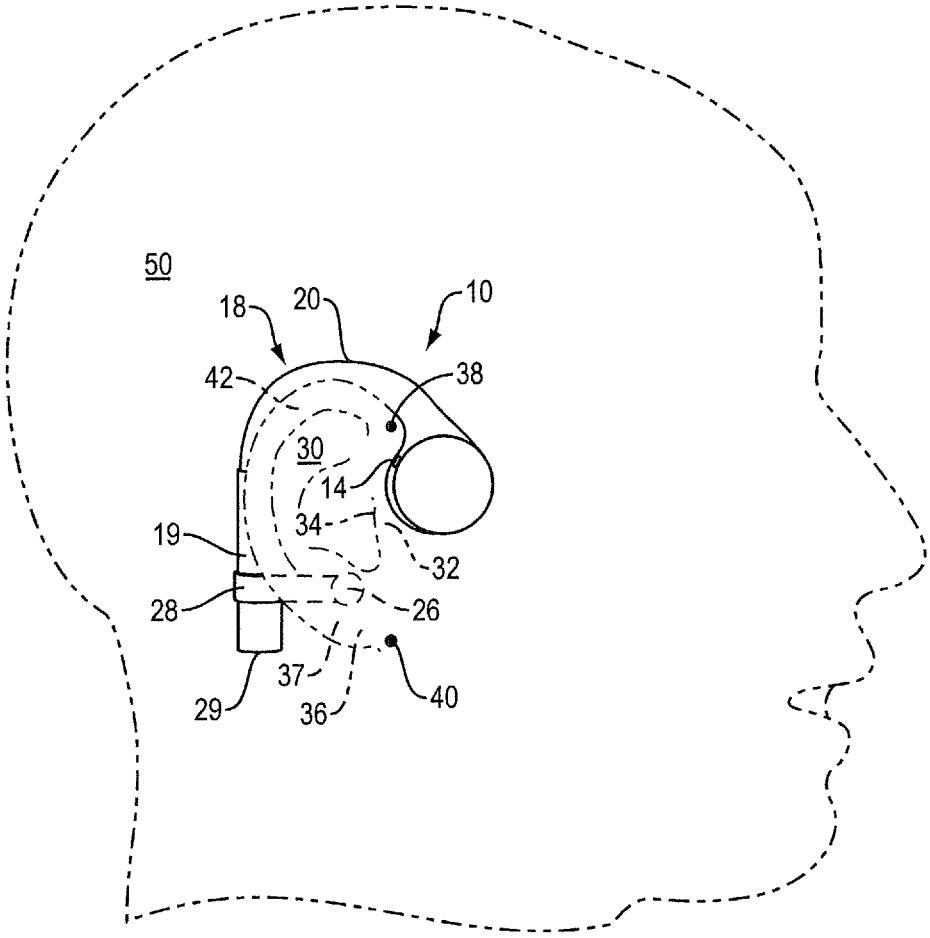
FIG. 1 is a side view of an audio device mounted to the right ear of a user.

Exemplary audio device 10 is depicted mounted to an ear in FIG. 1. Audio device 10 is carried on or proximate outer ear 30. Audio device 10 comprises acoustic module 12 that is configured to locate a sound-emitting opening 14 anteriorly of and proximate to the ear canal opening 34, which is behind (i.e., generally underneath) ear tragus 32. Acoustic modules that are configured to deliver sound to an ear are well known in the field and so are not fully described herein. Audio device 10 further includes body 18 that carries acoustic module 12 and is configured to be worn on or abutting outer ear 30 such that body 18 contacts the outer ear and/or the portion of the head 50 that abuts the outer ear. Arm 24 is coupled to body 18. Arm 24 comprises a distal end 26 that is configured to contact the ear root dimple 37 of the user. Arm 24 is configured to be moved in two directions along the length of body 18. Arm 24 is compliant. The adjustability and compliance of the arm allows arm distal end 26 to be located at the bottom of the outer ear of people with different anatomies as is further explained below. Force provided by the compliance of the arm can cause the body and arm to gently grip the outer ear and/or the ear root dimple region when the audio device is worn in this manner. The grip helps to maintain audio device 10 on the ear as the user moves. Arm 24 is adjustable, as further explained below, to allow the user to adjust audio device 10 so it fits comfortably but firmly on the ear.

Body 18 can at least in part be shaped generally to follow the ear root, which is the intersection of the outer ear and the head. Contact along the ear root, or the outer ear and/or the head abutting the ear root (collectively termed the ear root region), can be at one or more locations along the ear root. However, since the human head has many shapes and sizes, body 18 does not necessarily contact the ear root. Rather, it can be designed to have a shape such that it will, at least on most heads, contact the outer ear and/or the portion of the head that abuts the outer ear near the top of the ear. The arm distal end contacts the outer ear and/or the portion of the head that abuts the outer ear at the bottom of the ear. Since the contact of the audio device with the ear/head occurs at least at these two spaced locations, which are substantially or generally diametrically opposed, the result is a gripping force that maintains audio device 10 on the head as the head moves. The compliance of the arm can cause a slight compressive force at the opposed contact locations and so can lead to a grip on the head/ear that is sufficient to help retain the device in place on the head/ear as the head is moved. In one non-limiting example, one contact location is proximate the upper portion of the outer ear helix, and the opposed contact location is proximate the lower part of the ear or abutting head, such as near the otobasion inferius 40. In one non-limiting example, the opposed contact location is in or proximate the ear root dimple 37 that is located in most heads very close to or abutting or just posterior of the otobasion inferius 40. The audio device may be compliant at the portions that define one expected ear/head contact location (e.g., arm end 26), or each of two (or more) expected contact locations. For example, the audio device may include a compliant section at the contact location proximate the upper portion of the outer ear helix.

Audio device body 18 can be either rigid or compliant. In one non-limiting example, body 18 comprises a hollow molded plastic tube portion 19, with a battery located inside the tube. Alternatively, portion 19 can be a metal tube (e.g., stainless steel) and can have a silicone overcoat to increase comfort using a material that is appropriate for contact with the skin. Arm 24 is coupled to body 18 (e.g., to body portion 19), and is configured to be moved relative to body 18 and to bend, as further explained below. These movements and adjustments of arm 24 relative to body 18 allow arm distal end portion 26 to be located where desired relative to body 18. This allows distal end 26 to be located in the ear root dimple. This also allows the user to achieve a desired (and variable) clamping force of audio device 10 on the head and/or ear.

Figure 2A:
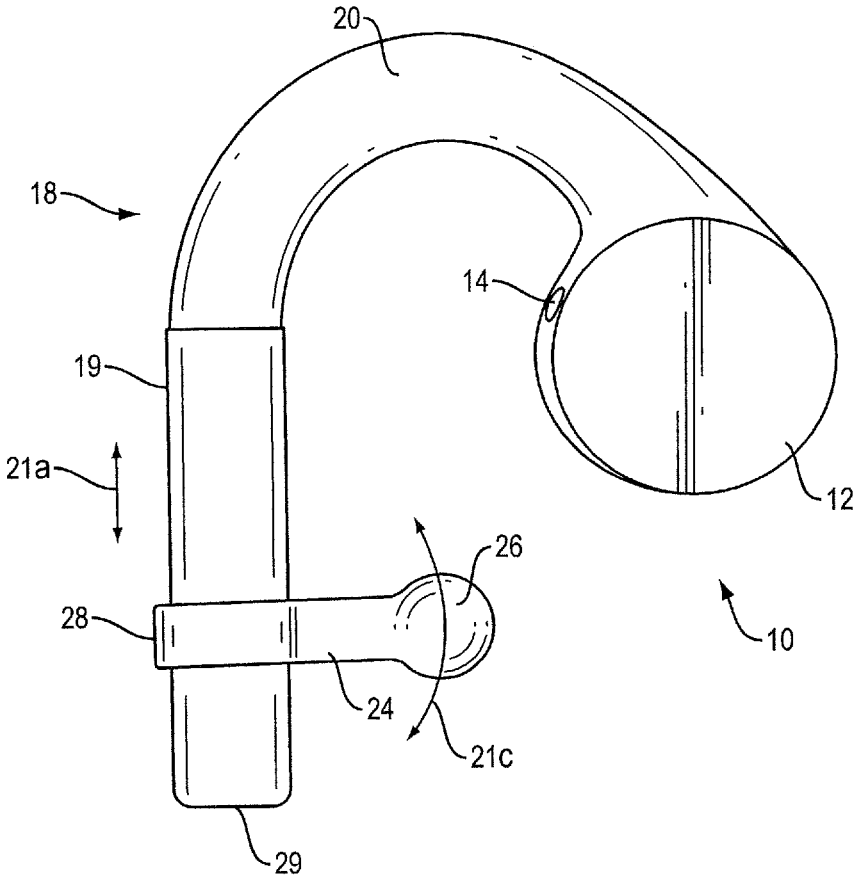
FIG. 2A is a side view of an audio device.

In one non-limiting example, arm 24 is continuously adjustable relative to body 18 to achieve the best fit and clamping force for the user. Vertical height adjustability of arm 24 is accomplished in this non-limiting example with integral sleeve 28 that fully or at least partially encircles straight body portion 19 and can be moved up and down (in the direction of arrow 21*a*) along the length of body portion 19. See FIG. 2A. Also, the angular position of arm distal end 26 relative to body portion 19 can be made adjustable (e.g., to accommodate different positions of ear root dimples) by configuring sleeve 28 such that it can be rotated in the direction of arrow 21*b* about longitudinal axis 22 of body portion 19; see FIG. 2B. The arm can be held in place on body portion 19 in any desired mechanical fashion, such as with a slight interference fit between sleeve 28 and body portion 19 that creates friction, and/or mechanical features, such as features (e.g., one or more small cavities) in the inside of sleeve 28 that mate with features (e.g., one or more small protrusions 50) on body portion 19. See FIGS. 3 and 4 for additional examples.

Figure 2B:
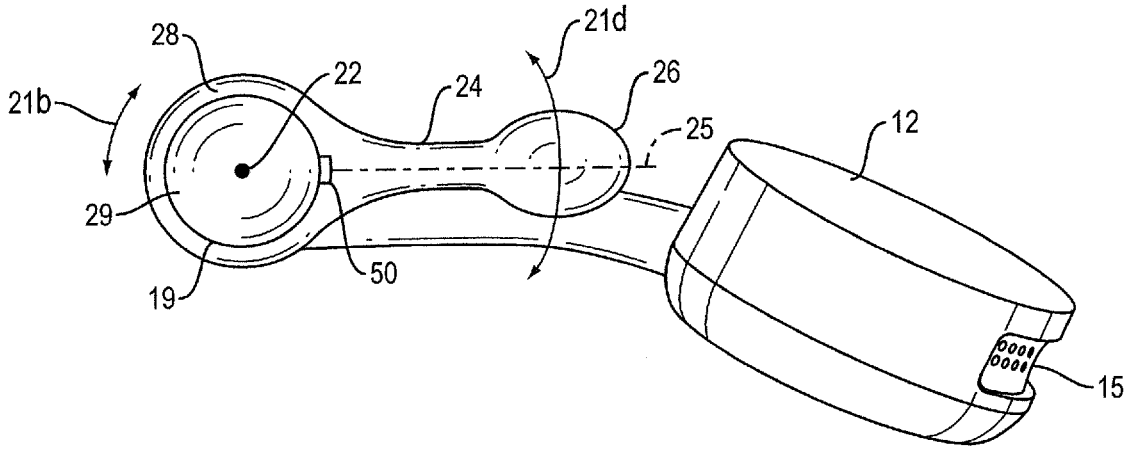
FIG. 2B is a bottom view of an audio device.

The horizontal and vertical position of arm distal end 26, and the amount of torque applied to body 18 via arm 24 and its distal end 26, can be made adjustable by configuring arm 24 such that it can be bent. Bending can be in one or both of the vertical direction (along arrow 21*c*, FIG. 2A) and the horizontal direction (along arrow 21*d*, FIG. 2B). In one non-limiting example, both bending modes can be accommodated by fabricating arm 24 of an elastomer (such as a silicone or a thermoplastic elastomer) that can be bent up and down and side-to-side relative to arm longitudinal axis 25 (see FIG. 2B). Horizontal bending can apply a torque to body 18, which can force acoustic module 12 against the head by pushing outward on the inside of the earlobe. This can help stabilize audio device 10 on the head. FIG. 2B also shows a second opening 15 in acoustic module 12. Opening 15 can provide access to a microphone and/or can function as a rear-side acoustic vent that can form a low-frequency dipole with front side vent 14. Acoustic dipoles in earphone acoustic modules are known in the field and so are not further described herein.

Audio device body 18 can at least in part generally follow the shape of the ear root. The anatomy of the ear and head adjacent to the ear, and manners in which an audio device can be carried on or near the ear, are further described in international patent application PCT/US18/51450 filed on Sep. 18, 2018, the entire disclosure of which is incorporated herein by reference for all purposes. Accordingly, not all aspects of the anatomy and fitting of an audio device to an ear are specifically described herein. Body 18 in this example includes generally "C"-shaped portion 20 that extends from an upper end (proximate otobasion superius 38) where it is coupled to acoustic module 12, to a lower end where it is coupled to portion 19. Some or all of portion 18 can be but need not be compliant. Compliance can be accomplished in one or more know mechanical manners. Examples include the choice of materials (e.g., using compliant materials such as elastomers or spring steel or the like) and/or a construction to achieve compliance (e.g., including compliant joints in the construction). Generally, but not necessarily, body 18 (e.g., portion 20) follows the ear root from the otobasion superius 38 (which is at the upper end of the ear root) to about the otobasion posterius (not shown).

Arm distal end 26 can be constructed and arranged to fit into or near the dimple or depression 37 (i.e., the ear root dimple) that is found in most people behind earlobe 36 and just posterior of the otobasion inferius 40. Distal end 26 can be generally round (e.g., generally spherical as shown in the drawings) and preferably has an upper arc-shaped surface that provides for an ear root region contact location along the arc, thus accommodating different head and ear sizes and shapes. Arm distal end 26 can be made from or include a compliant material (or made compliant in another manner), and so it can provide some grip to the head/ear. Body portion 20 at or around the ear root region proximate the upper portion 42 of the outer ear helix (which is generally the highest point of the outer ear) can also have compliance, but does not require compliance in order for the audio device to grip the ear. Since ear portion 42 is generally diametrically opposed to ear root dimple 37 (and to device portion 26 which contacts the ear root dimple), device compliance at one or more points proximate these two locations will provide a gripping force that will tend to hold audio device 10 on the head/ear even as the head is moved.

Since the device-to-ear/head contact points are both in the vicinity of the ear root (proximate upper ear upper portion 42 and in the vicinity of ear root dimple 37), the contact points are generally diametrically opposed. The opposed compliances create a resultant force on the device (the sum of contact force vectors, not accounting for gravity) that lies about in the line between the opposed contact regions. In this way, the device can be considered stable on the ear even in the absence of high contact friction (which adds to stabilization forces and so only helps to keep the device in place). Contrast this to a situation where the lower contact region is substantially higher up on the back of the ear. This would cause a resultant force on the device that tended to push and rotate it up and off the ear. By arranging the contact forces roughly diametrically opposed on the ear, and by creating points of contact on either side of or over an area of the upper ear root ridge 42, the device can accommodate a wider range of orientations and inertial conditions where the forces can balance, and the device can thus remain on the ear.

Stability is in part accomplished by a top-to-bottom clamping force on the outer ear, due to generally diametrically opposed clamping forces at the ear root ridge proximate the upper portion of the helix and at the ear root dimple. Clamping force at the ear root ridge proximate the upper portion of the helix is accomplished in this non-limiting example by arc-shaped body portion 20 that at least in part can sit behind upper helix portion 42, typically against one or both of the outer ear and the portion of the head adjacent to the outer ear. In one non-limiting example, portion 20 can be made from an elastomer (such as a thermoplastic elastomer, a thermoplastic urethane, or a silicone), or another compliant material. Alternatively, compliance could be accomplished, if desired, in another manner such as with a spring, or a spring embedded in an elastomer. Other options to accomplish a desired compliance and clamping force would be apparent to those skilled in the field and are included within the scope of this disclosure.

Arm end portion 26 can be generally spherical as shown, but that is not a limitation as it can have a different shape. End portion 26 acts as one point of contact with the ear and/or the head, and also helps audio device 10 to grip the head. End portion 26 also should have a shape, hardness and grip that allow it to sit comfortably in the ear root dimple. End portion 26 is preferably made from or coated with a material that helps to grip the skin. Examples include but are not limited to elastomers, textured elastomers, or high-friction coatings on a silicone body. The friction helps to keep end portion 26 in place. Also, the additional grip may allow the audio device to be held in place on the head with a lower top-to-bottom clamping force, which could make audio device 10 more comfortable to wear.

The vertical height adjustability, angular position adjustability, and vertical and horizontal bending of arm 24 accomplish several advantages. The vertical compression force applied to the ear can be adjusted to the user's ideal by shifting the vertical position of arm end portion 26 up or down. If the user wants more stability and doesn't mind perhaps slightly reduced comfort, the user can adjust the arm up so it is nominally fitted for a smaller ear height, and force the arm to bend more to fit arm end 26 in the ear root dimple. This would apply more clamping force. This state may be used, for example, in conditions where greater stability is desired, such as when running or exercising. Or if the user wants more comfort and less stability the user can adjust the arm down so it is looser. This may be desired, for example, in conditions where greater comfort is desired, such as when wearing the audio device at home or in an office setting for longer periods of time. Also, since the arm can be moved up and down the vertical compression force does not increase as ear size increases. Further, the compression force applied to the ear is always approximately vertical, which results in improved stability.

Further advantages of the body and arm design include: the device is relatively inexpensive, comprising a molded body 18 and an integral molded arm 24/sleeve 28. Arm 24/sleeve 28 can be made replaceable. Arm 24/sleeve 28 can be slipped off body end 29 and replaced. In addition, the device will not easily break as a result of abuse, and if it is damaged the arm can be replaced and does not require scrapping the entire audio device. In some examples, multiple sized arms can be included with the audio device, where each arm is a different length. By including more than one length of arm with the audio device, a larger variety of ear sizes can be accommodated. Further, the arm can be removed by the user if the user chooses comfort over stability.

The arm can be sized, shaped, located and made from material(s) that are designed to create desired locations of the arm distal end and forces due to location and bending of the arm. For example, the arm can be generally horizontal as shown in FIGS. 1 and 2, or could be angled down or up. The arm can be tapered as shown, or not, to create a desired bending and force profile. The arms can be different lengths, to accommodate different anatomies. The arm, arm distal end, and sleeve can be made from the same material, or not, or from material(s) with the same durometer, or not. For example, a desired frictional engagement of the arm on the audio device body can be created using a particular sleeve material and a particular degree of interference fit of the sleeve. If the sleeve material is too soft it may bend or fold as the arm is moved along the body. If the sleeve material is too hard the interference fit may be too tight to be readily adjustable by the user. The arm can be designed to create a particular compressive force and a particular clamping force. The arm distal end can be shaped and sized and have material properties, as desired. For example, a larger ball/sphere will distribute force over a larger contact area and so may make the device more comfortable. However, a smaller ball may fit more people's ear root dimple. A softer ball may be more deformable and so may be better at conforming to the ear root dimple.

Figure 3:
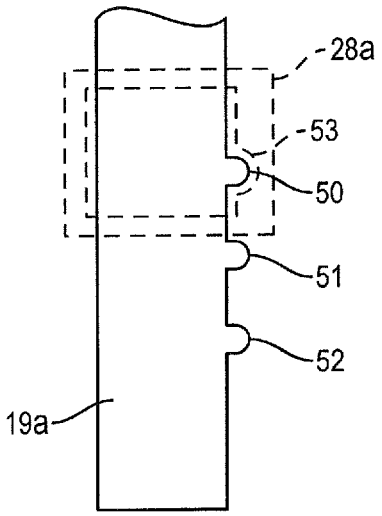
FIG. 3 is a partial view of an audio device body and the sleeve of an arm engaged with the audio device body.

FIG. 3 illustrates mating features on body portion 19*a* (only some of which is shown) and arm sleeve 28*a* that can be used in lieu of or in addition to an interference fit, to hold the arm in place on the body. The inside of sleeve 28*a* includes one or more small cavities or indentations, with a single cavity 53 illustrated. Body 19*a* includes one or more protrusions; in this non-limiting example there are three spaced identical protrusions 50, 51, and 52. Sleeve 28*a* will be held in place when its cavity 53 is directly over one of protrusions 50-52. The spacing of protrusions 50-52 could create distances of the arm distal end from body portion 20 that are configured to fit a small, medium and large ear. The arm can then be bent as desired by the user to develop a desired clamping force and comfort. Other similar arrangements of mating mechanical features on the sleeve and body (not shown) can be used to accomplish similar results. For example, the cavity in the sleeve can be elongated in the circumferential direction to create a slot with end-walls that act as rotation stops. The slot would allow the sleeve to be turned in both directions over a defined angular extent before the mating protuberance on the body contacted a slot end wall. The slot can thus be used to create a predetermined maximum extent by which the arm can be adjusted in angular position. This can help ensure the arm is not turned so far as to be ineffective, or used in an unintended fashion.

Figure 4:
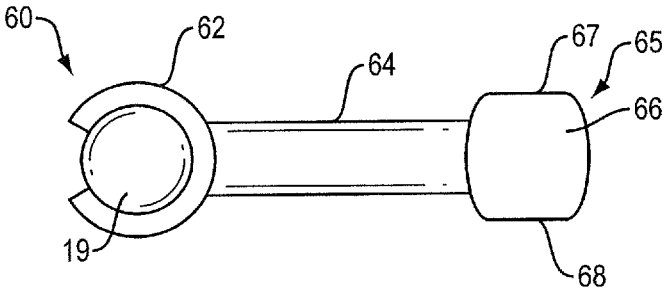
FIG. 4 is a bottom view of an arm engaged with an audio device body.

FIG. 4 illustrates a different sleeve/arm/arm end structure 60 fitted over body portion 19. Sleeve 62 partially rather than fully surrounds body portion 19 as shown. Integral arm 64 leads to integral arm end 65, which has a curved top 66 that will fit into the ear root dimple. End 65 in this case has a shape of a sphere with its opposed sides 67 and 68 lopped off. This creates an end with less thickness than a spherical end. The thinner end may not push the earlobe out and away from the head and so may be more comfortable to wear, without sacrificing the function associated with a curved surface contacting the ear root dimple. Other arm end shapes (not shown) are contemplated, including shapes that define a curve or arc where the end will contact the ear root, or not.

In some examples, the integral arm 64 may extend in a substantially straight line from sleeve 62 and have a substantially constant thickness, as shown in FIG. 4. In other examples, the integral arm 24 may extend in a substantially straight line from sleeve 28 (as shown, for example, in FIG. 2A), but have a varying thickness, such as a wedge shape that is thicker towards the side of the sleeve 28 and tapers when moving toward the arm distal end 26; see FIG. 2B. And in yet other examples, the integral arm 24 may extend at an upward or downward angle from sleeve 28.

The arm may be constructed of a compliant material such as silicone. In some examples, the sleeve 28, integral arm 24 and distal end 26 may be constructed of a material (such as silicone) having the same durometer throughout. In other examples, the sleeve 28, integral arm 24 and distal end 26 may be constructed of one or more differing durometer materials. For example, the distal end 26 may be constructed of a relatively softer durometer material compared to the sleeve 28 and integral arm 24 to provide comfort at the point of contact with the user's ear; the sleeve 28 may be constructed of a relatively harder durometer material compared to the integral arm 24 and distal end 26 to provide more stability to the sleeve 19 at its mating point with the body portion 19, and so that sleeve 28 does not easily deform when it is moved relative to body portion 19; and integral arm 24 may be constructed of a durometer material that is softer than the durometer of sleeve 28 but harder than the durometer of distal end 26 to provide the appropriate compressive force to the ear. Alternatively, the integral arm 24 may be constructed of a material with a durometer that is the same as either the sleeve 28 or distal end 26.

A number of implementations have been described. Nevertheless, it will be understood that additional modifications may be made without departing from the scope of the inventive concepts described herein, and, accordingly, other examples are within the scope of the following claims.

What is claimed is:

1. An audio device, comprising:

a body having a length and configured to be worn on or abutting an outer ear of a user;

an arm coupled to the body and defining a distal end that is configured to contact an ear root dimple of the user, wherein the ear root dimple is a feature of the head at the bottom of the ear and located medially of the user's earlobe, wherein the arm is configured to be moved relative to the body; and an acoustic module carried by the body and configured to locate a sound-emitting opening in the acoustic module such that the sound-emitting opening is spaced from, anterior of, and proximate to, the user's ear canal opening when the body is worn on or abutting the ear of the user.

2. The audio device of claim 1, wherein the body is configured to contact at least one of the outer ear and the portion of the head that abuts the outer ear proximate the upper portion of the outer ear helix.

3. The audio device of claim 2, wherein the body extends generally along an arc where it is configured to contact at least one of the outer ear and the portion of the head that abuts the outer ear proximate the upper portion of the outer ear helix.

4. The audio device of claim 1, wherein the distal end of the arm comprises an at least partially rounded member that is configured to sit in the ear root dimple.

5. The audio device of claim 1, wherein the arm is flexible.

6. The audio device of claim 5, wherein the arm is made from an elastomer.

7. The audio device of claim 1, wherein the arm is configured to bend along first and second orthogonal bend axes.

8. The audio device of claim 7, wherein the arm lies along an arm longitudinal axis, and wherein the first bend axis is the arm longitudinal axis and the second bend axis is a vertical axis.

9. The audio device of claim 1, wherein the body in part lies along a body axis.

10. The audio device of claim 9, wherein the arm is configured to be rotated about the body axis.

11. The audio device of claim 9, wherein the arm is configured to be moved in two directions along the body axis.

12. The audio device of claim 9, wherein the arm is coupled to the body by a sleeve that at least partially surrounds the body.

13. The audio device of claim 12, wherein the sleeve is configured to have an interference fit with the body to create friction that helps hold the sleeve in place on the body.

14. The audio device of claim 12, wherein the sleeve is configured to be moved in two directions along the body axis and rotate about the body axis.

15. The audio device of claim 1, wherein the arm comprises features that mate with undercut features on the body.

16. An audio device, comprising:

a body having a length and configured to be worn on or abutting an outer ear of a user, wherein the body in part lies along a body axis;

a flexible arm coupled to the body and defining a distal end that is configured to contact an ear root dimple of the user, wherein the ear root dimple is a feature of the head at the bottom of the ear and located medially of the user's earlobe, wherein the arm is configured to be moved along the length of the body, to be rotated about the body axis, and to bend along first and second orthogonal bend axes; and an acoustic module carried by the body and configured to locate a sound-emitting opening in the acoustic module such that the sound-emitting opening is spaced from, anterior of, and proximate to, the user's ear canal opening when the body is worn on or abutting the ear of the user.

17. The audio device of claim 16, wherein the distal end of the arm comprises an at least partially rounded member that is configured to sit in the ear root dimple.

18. The audio device of claim 16, wherein the arm is coupled to the body by a sleeve that at least partially surrounds the arm.

19. The audio device of claim 18, wherein the sleeve is configured to have an interference fit with the body to create friction that helps hold the sleeve in place on the body.

20. The audio device of claim 18, wherein the sleeve is configured to be moved in two directions along the body axis and rotate about the body axis.

* * * * *